US012173242B2

(12) United States Patent
Gattupalli et al.

(10) Patent No.: US 12,173,242 B2
(45) Date of Patent: Dec. 24, 2024

(54) PROCESS FOR MAXIMIZING PRODUCTION OF HEAVY NAPHTHA FROM A HYDROCARBON STREAM

(71) Applicant: UOP LLC, Des Plaines, IL (US)

(72) Inventors: Rajeswar Gattupalli, Morris Plains, NJ (US); Rajaraman Panchapakesan, Morris Plains, NJ (US); Krishna M, Morris Plains, NJ (US); Deepak Bisht, Morris Plains, NJ (US); Soumendra Mohan Banerjee, Morris Plains, NJ (US)

(73) Assignee: UOP LLC, Des Plaines, IL (US)

( * ) Notice: Subject to any disclaimer, the term of this patent is extended or adjusted under 35 U.S.C. 154(b) by 0 days.

(21) Appl. No.: 17/280,230

(22) PCT Filed: Sep. 28, 2019

(86) PCT No.: PCT/US2019/053699
§ 371 (c)(1),
(2) Date: Mar. 26, 2021

(87) PCT Pub. No.: WO2020/069472
PCT Pub. Date: Apr. 2, 2020

(65) Prior Publication Data

US 2021/0340449 A1 Nov. 4, 2021

(30) Foreign Application Priority Data

Sep. 29, 2018 (IN) ..... 201811036898

(51) Int. Cl.
*C10G 65/10* (2006.01)
*C10G 47/00* (2006.01)
(Continued)

(52) U.S. Cl.
CPC ..... *C10G 67/14* (2013.01); *C10G 47/00* (2013.01); *C10G 65/10* (2013.01); *C10G 65/18* (2013.01);
(Continued)

(58) Field of Classification Search
CPC ..... C10G 47/00; C10G 2300/1055; C10G 2300/1074; C10G 2300/4012; C10G 2300/4081; C10G 65/10; C10G 65/18
See application file for complete search history.

(56) References Cited

U.S. PATENT DOCUMENTS 2,945,800 A * 7/1960 Coonradt ..... C10G 63/04 208/59
3,092,567 A * 6/1963 Mason ..... C10G 47/00 208/89
(Continued)

FOREIGN PATENT DOCUMENTS

CN 102453535 A 5/2012
CN 106350114 A * 1/2017
(Continued)

OTHER PUBLICATIONS

Office Action for corresponding CN Application No. 201980066862.5.

*Primary Examiner* — Michelle Stein
(74) *Attorney, Agent, or Firm* — Paschall & Associates, LLC; James C. Paschall

(57) ABSTRACT

A process for maximizing production of heavy naphtha from a hydrocarbon stream is disclosed. The process comprises providing a hydrocarbon feed stream comprising diesel to a separation column to provide a light diesel stream and a heavy diesel stream. The heavy diesel stream is hydrocracked in the presence of a hydrogen stream and a first hydrocracking catalyst in a first hydrocracking reactor at a first hydrocracking pressure of 13790 kPa to 17237 kPa to
(Continued)

provide a first hydrocracked effluent stream. The light diesel stream is hydrocracked in the presence of a hydrogen stream and a second hydrocracking catalyst in a second hydrocracking reactor at a second hydrocracking pressure of 3450 kPa to 6205 kPa to provide a second hydrocracked effluent stream. At least a portion of the first hydrocracked effluent stream and at least a portion of the second hydrocracked effluent stream are fractioned to produce heavy naphtha.

20 Claims, 2 Drawing Sheets

(51) Int. Cl.
*C10G 65/18* (2006.01)
*C10G 67/14* (2006.01)

(52) U.S. Cl.
CPC ..... *C10G 2300/1055* (2013.01); *C10G 2300/1074* (2013.01); *C10G 2300/4012* (2013.01); *C10G 2300/4081* (2013.01)

(56) References Cited

U.S. PATENT DOCUMENTS 3,132,090 A * 5/1964 Helfrey ..... C10G 65/12 208/2
3,157,589 A * 11/1964 Scott, Jr. ..... C10G 65/18 208/108
3,166,489 A * 1/1965 Mason ..... C10G 47/36 208/143
3,172,839 A * 3/1965 Kozlowski ..... C10G 47/00 208/143
3,224,958 A * 12/1965 Schlinger ..... C10G 49/007 208/100
5,082,551 A * 1/1992 Reynolds ..... C10G 49/22 208/103
5,183,556 A * 2/1993 Reilly ..... C10G 65/08 208/143
5,403,469 A * 4/1995 Vauk ..... C10G 65/14 208/103
7,470,358 B1 * 12/2008 Kalnes ..... C10G 65/14 208/89
8,158,069 B1 * 4/2012 Wieber ..... C10G 47/14 422/187
8,999,152 B2 4/2015 Stewart et al.
9,074,139 B2 7/2015 Quignard et al.
10,550,338 B2 * 2/2020 Eizenga ..... C10G 65/12
2005/0218039 A1 * 10/2005 Kaines ..... C10G 65/00 208/210
2006/0131212 A1 * 6/2006 Dahlberg ..... C10G 65/12 208/89
2013/0259765 A1 * 10/2013 Zimmerman ..... C10G 49/002 422/187
2014/0221712 A1 * 8/2014 Greene ..... C10G 65/00 208/57
2014/0262963 A1 * 9/2014 Stewart ..... C10G 7/00 208/364
2014/0275672 A1 * 9/2014 Krishnamurthy ..... C10G 65/10 422/111
2015/0361358 A1 * 12/2015 Roney ..... C10G 65/12 208/78
2017/0128919 A1 * 5/2017 Liu ..... C10G 47/02

FOREIGN PATENT DOCUMENTS

CN 105802665 A 7/2017
CN 108795495 A * 11/2018 ..... C10G 69/00
CN 109694732 A * 4/2019 ..... C10G 67/02

* cited by examiner

PROCESS FOR MAXIMIZING PRODUCTION OF HEAVY NAPHTHA FROM A HYDROCARBON STREAM

TECHNICAL FIELD

This disclosure is generally directed to a process for maximizing production of heavy naphtha from a hydrocarbon stream. More specifically, this disclosure relates to hydrocracking a heavy diesel stream and a light diesel stream to produce heavy naphtha.

BACKGROUND

Currently, there is an increasing trend worldwide towards moving from fuel mode to petrochemical mode. Refiners are tapping every opportunity to maximize the production of petrochemicals. One among them is to utilize the comparatively less valuable hydrocarbons or distressed hydrocarbons stream from the existing processes to produce petrochemicals. Refiners are striving to convert this range of hydrocarbons into valuable petrochemicals.

Heavy naphtha is primarily used as a petrochemical feedstock for running the aromatic complexes and naphtha crackers and produce more valuable petrochemical products like para-xylene. However, as heavy naphtha demand is increasing, refiners are looking for alternative processes to obtain heavy naphtha from less valuable hydrocarbons to produce more valuable products. Integrated refineries with petrochemical complexes are increasingly looking at value addition in terms of inter alia aromatic yields that are obtained from a barrel of crude oil.

Further, heavy naphtha being produced from the crude oil distillation, is not sufficient to meet the increasing market demand for para-xylene production. Therefore, in order to meet the para-xylene demand, producers need to import heavy naphtha from the open market. However, heavy naphtha available in the open market is also not sufficient to meet the para-xylene demand. Therefore, refiners are tapping alternate options to maximizing the production of heavy naphtha thereby meeting market the demand of heavy naphtha for para-xylene production and reducing the reliance on import. One of the alternate option available to refiners is hydrocracking a diesel stream to produce heavy naphtha. However, the existing processes for diesel hydrocracking require sheer pressure to produce heavy naphtha thereby posing economic constraints.

Accordingly, it is desirable to provide new apparatuses and processes for producing heavy naphtha from a distressed diesel stream. Further, there is a need for an alternative approach to maximize the production of heavy naphtha economically with reducing the capital. Expenditure (CAPEX) and operating expenditure (OPEX) for the production of heavy naphtha and which can be easily integrated with an existing hydroprocessing complex. Furthermore, other desirable features and characteristics of the present subject matter will become apparent from the subsequent detailed description of the subject matter and the appended claims, taken in conjunction with the accompanying drawings and this background of the subject matter.

SUMMARY

Various embodiments contemplated herein relate to processes and apparatuses for maximizing production of heavy naphtha from a hydrocarbon stream. The exemplary embodiments taught herein provide a process for producing a naphtha stream. As described later, the present process also allows integration of kerosene or light diesel hydrocracking reactor with an existing VGO hydrocracking reactor to economically produce heavy naphtha.

In accordance with an exemplary embodiment, a process for maximizing production of heavy naphtha from a hydrocarbon stream is disclosed. The process comprising providing a hydrocarbon feed stream comprising diesel to a separation column to provide a light diesel stream and a heavy diesel stream. The heavy diesel stream is hydrocracked in the presence of a hydrogen stream and a first hydrocracking catalyst in a first hydrocracking reactor operating at first hydrocracking conditions comprising a first hydrocracking pressure of 13790 kPa (2000 psig) to 17237 kPa (2500 psig) to provide a first hydrocracked effluent stream. The light diesel stream is hydrocracked in the presence of a hydrogen stream and a second hydrocracking catalyst in a second hydrocracking reactor operating at second hydrocracking conditions comprising a second hydrocracking pressure of 3450 kPa (500 psig) to 6205 kPa (900 psig) to provide a second hydrocracked effluent stream. Thereafter, at least a portion of the first hydrocracked effluent stream and at least a portion of the second hydrocracked effluent stream are fractioned to produce heavy naphtha.

In accordance with another exemplary embodiment, a process for maximizing production of heavy naphtha from a hydrocarbon stream is provided. The process comprises providing a hydrocarbon feed stream comprising diesel to a separation column to provide a light diesel stream and a heavy diesel stream. The heavy diesel stream is hydrocracked in the presence of a hydrogen stream and a first hydrocracking catalyst in a first hydrocracking reactor operating at first hydrocracking conditions comprising a first hydrocracking pressure of 13790 kPa (2000 psig) to 17237 kPa (2500 psig) to provide a first hydrocracked effluent stream. The light diesel stream is hydrocracked in the presence of a hydrogen stream and a second hydrocracking catalyst in a second hydrocracking reactor operating at second hydrocracking conditions comprising a second hydrocracking pressure of 3450 kPa (500 psig) to 6205 kPa (900 psig) to provide a second hydrocracked effluent stream. At least a portion of the first hydrocracked effluent stream and at least a portion of the second hydrocracked effluent stream are fractioned to provide a heavy naphtha fraction, a light diesel fraction, and a heavy diesel fraction. Thereafter, at least a portion of the heavy diesel fraction is passed to the first hydrocracking reactor and at least a portion of the light diesel fraction is passed to the second hydrocracking reactor to maximize the production of heavy naphtha.

In accordance with yet another exemplary embodiment, a process for maximizing production of heavy naphtha from a hydrocarbon stream is disclosed. The process comprises providing a hydrocarbon feed stream comprising diesel to a separation column to provide a light diesel stream and a heavy diesel stream. The heavy diesel stream and a vacuum gas oil stream are hydrocracked in the presence of a hydrogen stream and a first hydrocracking catalyst in a first hydrocracking reactor at first hydrocracking conditions comprising a first hydrocracking pressure of 13790 kPa (2000 psig) to 17237 kPa (2500 psig) to provide a first hydrocracked effluent stream. At least a portion of the first hydrocracked effluent stream is passed to a first fractionation column to provide one or more fractionation products including a heavy naphtha stream, a heavy diesel fraction and a light diesel fraction. The light diesel stream is hydrocracked in a second hydrocracking reactor operating at second hydrocracking conditions comprising a second hydrocracking pressure of 3450 kPa (500 psig) to 6205 kPa (900 psig) to provide a second hydrocracked effluent stream. The second hydrocracked effluent stream is passed to a second fractionation column to provide one or more fractionation products including a heavy naphtha stream. At least a portion of the heavy diesel fraction is passed to the first hydrocracking reactor and at least a portion of the light diesel fraction is passed to the second hydrocracking reactor to maximize the production of heavy naphtha.

Applicants have discovered that the hydrocarbon feed comprising diesel can be separated in to a light diesel stream and a heavy diesel stream. This diesel stream can be hydrocracked with kerosene in an existing kerosene or light diesel hydrocracking unit at a low pressure and the heavy diesel stream can be hydrocracked with a vacuum gas oil (VGO) stream in an existing VGO hydrocracking unit at a higher pressure compared to the kerosene or light diesel hydrocracking unit. Accordingly, the light diesel stream may be hydrocracked in a kerosene or light diesel hydrocracking reactor at a pressure from 3450 kPa (500 psig) to 6205 kPa (900 psig) and the heavy diesel stream may be routed to a VGO hydrocracking reactor which typically operates at a higher pressure compared to the kerosene or light diesel hydrocracking reactor. Further, a VGO stream can also be hydrocracked with the heavy diesel stream in the VGO hydrocracking reactor. Therefore, the present process also allows integration of kerosene or light diesel hydrocracking reactor with an existing VGO hydrocracking reactor to produce heavy naphtha. Thus, the present process maximizes the production of heavy naphtha economically with reducing the CAPEX and OPEX and can be easily integrated with an existing VGO hydrocracking reactor.

These and other features, aspects, and advantages of the present invention will become better understood upon consideration of the following detailed description, drawings and appended claims.

BRIEF DESCRIPTION OF THE DRAWINGS

The various embodiments will hereinafter be described in conjunction with the following FIGURES, wherein like numerals denote like elements.

DEFINITIONS

Figure 1:
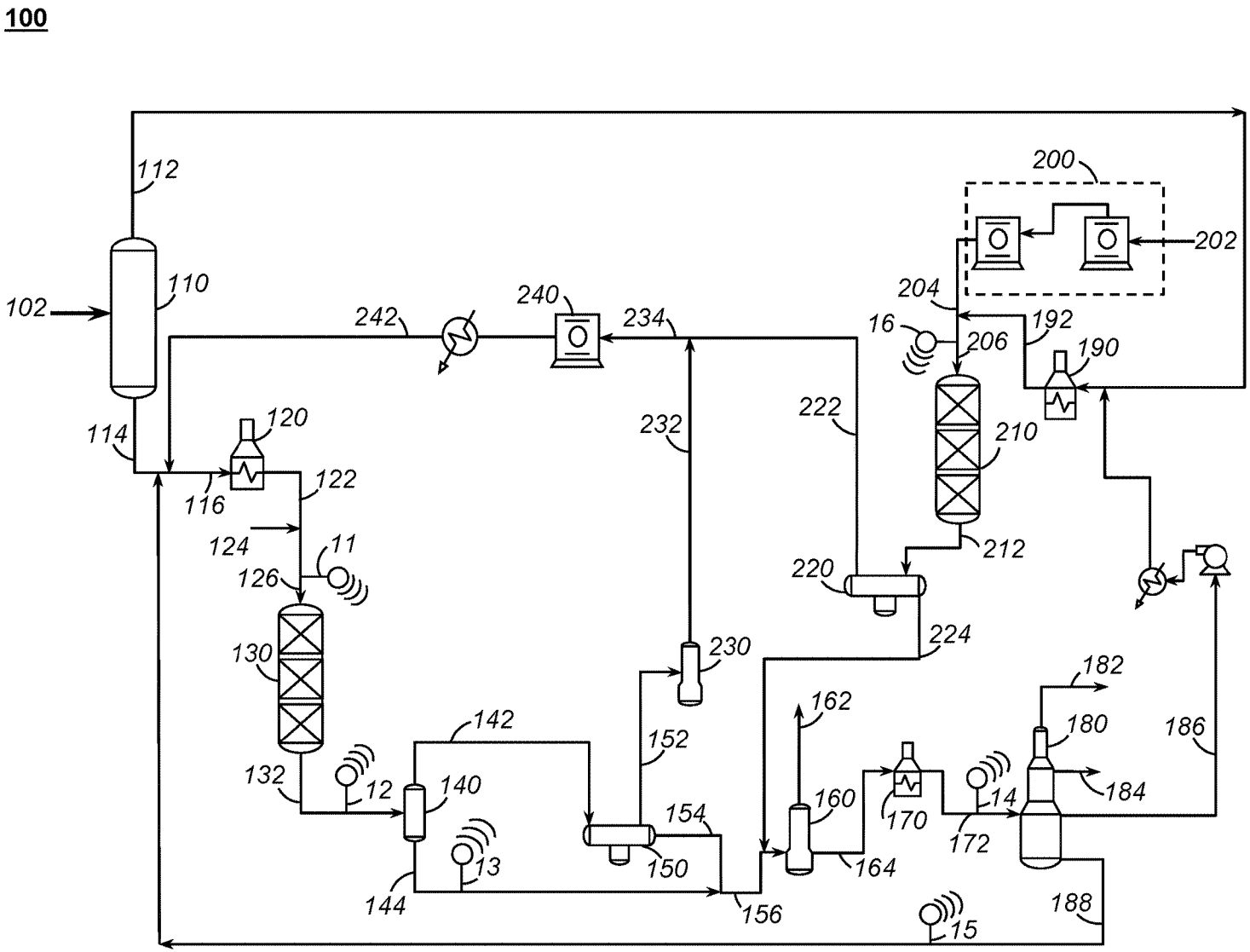
FIG. 1 is a schematic diagram of a process and apparatus for maximizing production of heavy naphtha from a hydrocarbon stream in accordance with an exemplary embodiment.

As used herein, the term "stream" can include various hydrocarbon molecules and other substances.

As used herein, the term "column" means a distillation column or columns for separating one or more components of different volatilities. Unless otherwise indicated, each column includes a condenser on an overhead of the column to condense the overhead vapor and reflux a portion of an overhead stream back to the top of the column. Also included is a reboiler at a bottom of the column to vaporize and send a portion of a bottom stream back to the bottom of the column to supply fractionation energy. Feeds to the columns may be preheated. The top pressure is the pressure of the overhead vapor at the outlet of the column. The bottom temperature is the liquid bottom outlet temperature. Overhead lines and bottom lines refer to the net lines from the column downstream of the reflux or reboil to the column. Alternatively, a stripping stream may be used for heat input at the bottom of the column.

As used herein, the term "overhead stream" can mean a stream withdrawn in a line extending from or near a top of a vessel, such as a column.

As used herein, the term "bottoms stream" can mean a stream withdrawn in a line extending from or near a bottom of a vessel, such as a column.

As used herein, the term "predominantly" can mean an amount of generally at least 50% or at least 75%, preferably 85%, and optimally 95%, by mole, of a compound or class of compounds in a stream.

As used herein, the term "rich" can mean an amount of generally at least 50% or at least 70%, preferably 90%, and optimally 95%, by mole, of a compound or class of compounds in a stream. Broadly, the term "rich" refers to the fact an outlet stream from a column has a greater percentage of a certain component that present in the inlet feed to the column.

As used herein, the term "True Boiling Point" (TBP) means a test method for determining the boiling point of a material which corresponds to ASTM D2892 for the production of a liquefied gas, distillate fractions, and residuum of standardized quality on which analytical data can be obtained, and the determination of yields of the above fractions by both mass and volume from which a graph of temperature versus mass % distilled is produced using fifteen theoretical plates in a column with a 5:1 reflux ratio.

As used herein, the term "diesel" means hydrocarbons boiling in the range using the True Boiling Point distillation method of a T5 between 150° C. (302° F.) and 200° C. (392° F.), and a T95 between 343° C. (650° F.) and 399° C. (750° F.).

As used herein, the term "light diesel" means hydrocarbons boiling in the range using the True Boiling Point distillation method of a T5 between 150° C. (302° F.) and 200° C. (392° F.), and a T95 between 260° C. (500° F.) and 330° C. (626° F.), preferably a T95 between 270° C. (518° F.) and 320° C. (608° F.).

As used herein, the term "heavy diesel" means hydrocarbons boiling in the range using the True Boiling Point distillation method of a T5 between 260° C. (500° F.) and 330° C. (626° F.), preferably a T5 between 270° C. (518° F.) and 320° C. (608° F.), and a T95 between 343° C. (650° F.) and 399° C. (750° F.).

As used herein, the term "heavy naphtha" means hydrocarbons boiling in the range using the True Boiling Point distillation method of T5 between 20° C. (68° F.) and 40° C. (104° F.), and T95 between 140° C. (284° F.) and 180° C. (356° F.).

As used herein, the term "T5" or "T95" means the temperature at which 5 volume percent or 95 volume percent, as the case may be, respectively, of the sample boils using TBP or ASTM D-86.

As used herein, the term "separator" means a vessel which has an inlet and at least an overhead vapor outlet and a bottoms liquid outlet and may also have an aqueous stream outlet from a boot. A flash drum is a type of separator which may be in downstream communication with a separator. The separator may be operated at higher pressure.

As used herein, the term "passing" includes "feeding" and "charging" and means that the material passes from a conduit or vessel to an object.

DETAILED DESCRIPTION

The following detailed description is merely exemplary in nature and is not intended to limit the various embodiments or the application and uses thereof. Furthermore, there is no intention to be bound by any theory presented in the preceding background or the following detailed description. The Figures have been simplified by the deletion of a large number of apparatuses customarily employed in a process of this nature, such as vessel internals, temperature and pressure controls systems, flow control valves, recycle pumps, etc. which are not specifically required to illustrate the performance of the invention. Furthermore, the illustration of the process of this invention in the embodiment of a specific drawing is not intended to limit the invention to specific embodiments set out herein.

As depicted, process flow lines in the figures can be referred to, interchangeably, as, e.g., lines, pipes, branches, distributors, streams, effluents, feeds, products, portions, catalysts, withdrawals, recycles, suctions, discharges, and caustics.

An embodiment of a process for maximizing production of heavy naphtha from a hydrocarbon stream is addressed with reference to a process and apparatus 100 according to an embodiment as shown in FIG. 1. Referring to FIG. 1, the process and apparatus 100 comprises a separation column 110, a first hydrocracking reactor 130, a common stripper 160, a fractionation column 180, and a second hydrocracking reactor 210. As shown, a hydrocarbon feed stream comprising diesel in line 102 is passed to the separation column 110, the hydrocarbon feed stream is split to provide a light diesel stream and a heavy diesel stream. The light diesel stream is withdrawn in line 112 as an overhead stream and the heavy diesel stream may be withdrawn in line 114 as a bottom stream from the separation column 110. In an embodiment, the separation column 110 may be a fractionation column wherein the hydrocarbon feed stream in line 102 may be fractioned at a temperature from 150° C. to 400° C. However, not limiting by the fractionation column, the separation column 110 may be any other column suitable for separating the hydrocarbon feed stream in to the light diesel stream and the heavy diesel stream. Thereafter, the heavy diesel stream in line 114 is passed to the first hydrocracking reactor 130 to hydrocrack the heavy diesel stream in the presence of a hydrogen stream and a first hydrocracking catalyst in the first hydrocracking reactor operating at first hydrocracking conditions. In various embodiments, a vacuum gas oil (VGO) may be also passed to the first hydrocracking reactor 130 and processed together with the heavy diesel stream. A first hydrocracked effluent stream is withdrawn in line 132.

As shown in FIG. 1, the heavy diesel stream in line 114 may be passed to a pre-heater 120 prior to hydrocracking to provide a preheated stream in line 122. As described hereinafter in detail, a hydrogen rich stream in line 242 and a recycled heavy diesel fraction in line 188 may also be combined with the heavy diesel stream in line 114 to provide a combined stream in line 116. The combined stream may be then passed to the pre-heater 120. However, the hydrogen rich stream in line 242, the recycled heavy diesel fraction in line 188 may be passed to the pre-heater 120 separately. The pre-heater 120 is optionally used to reduce the heat load on the downstream hydrocracking reactor. And, the hydrogen rich stream in line 242 and the recycled heavy diesel fraction in line 188 may be passed directly to the hydrocracking reactor 130. A hydrogen stream in line 124 may also be passed to the hydrocracking reactor 130. As shown, the hydrogen stream in line 124 may be combined with preheated stream in line 122 and a combined stream in line 126 may be then passed to the first hydrocracking reactor 130. In the first hydrocracking reactor 130, the heavy diesel stream is hydrocracked in the presence of the hydrogen stream and the first hydrocracking catalyst at first hydrocracking conditions comprising a first hydrocracking pressure of 13790 kPa (2000 psig) to 17237 kPa (2500 psig) to provide a first hydrocracked effluent stream in line 132 from the bottom of the first hydrocracking reactor 130. The first hydrocracking reactor 130 may comprise one or more beds of the first hydrocracking catalyst to provide the first hydrocracked effluent stream. Although not shown in FIG. 1, the combined stream in line 126 may be separated into a plurality of streams. Therefore, a stream from the plurality of streams may be sent to a top hydrocracking catalyst bed and remaining streams being passed to the downstream hydrocracking catalyst beds in the first hydrocracking reactor 130 as a quench stream for the stream coming through the upstream hydrocracking catalyst bed. Each bed may comprise similar or different hydrocracking catalyst compared to the other beds of the first hydrocracking reactor 130.

The catalyst beds of the hydrocracking reactor 120 may comprise any suitable catalyst including but not limited to catalysts that utilize amorphous silica-alumina bases or low-level zeolite bases combined with one or more Group VIII or Group VIB metal hydrogenating components. The zeolite cracking bases are sometimes referred to in the art as molecular sieves and are usually composed of silica, alumina and one or more exchangeable cations such as sodium, magnesium, calcium, rare earth metals, etc. They are further characterized by crystal pores of relatively uniform diameter between 4 and 14 Angstroms. Zeolites having a relatively high silica/alumina mole ratio between 3 and 12 may be employed. Suitable zeolites found in nature include, for example, mordenite, stilbite, heulandite, ferrierite, dachiardite, chabazite, erionite and faujasite. Suitable synthetic zeolites include, for example, the B, X, Y and L crystal types, e.g., synthetic faujasite and mordenite. The preferred zeolites are those having crystal pore diameters between 8-12 Angstroms, wherein the silica/alumina mole ratio is 4 to 6. One example of a zeolite falling in the preferred group is synthetic Y molecular sieve.

The natural occurring zeolites are normally found in a sodium form, an alkaline earth metal form, or mixed forms. The synthetic zeolites are nearly always prepared first in the sodium form. In any case, for use as a cracking base it is preferred that most or all of the original zeolitic monovalent metals be ion-exchanged with a polyvalent metal and/or with an ammonium salt followed by heating to decompose the ammonium ions associated with the zeolite, leaving in their place hydrogen ions and/or exchange sites which have actually been decationized by further removal of water. Zeolites, such as Y zeolites may be steamed and acid washed to dealuminate the zeolite structure.

Mixed polyvalent metal-hydrogen zeolites may be prepared by ion-exchanging first with an ammonium salt, then partially back exchanging with a polyvalent metal salt and then calcining. In some cases, as in the case of synthetic mordenite, the hydrogen forms can be prepared by direct acid treatment of the alkali metal zeolites. In one aspect, the preferred cracking bases are those which are at least 10 percent, and preferably at least 20 percent, metal-cation-deficient, based on the initial ion-exchange capacity. In another aspect, a desirable and stable class of zeolites is one wherein at least 20 percent of the ion exchange capacity is satisfied by hydrogen ions.

The active metals employed in the preferred hydrocracking catalysts of the present invention as hydrogenation components are those of Group VIII, i.e., iron, cobalt, nickel, ruthenium, rhodium, palladium, osmium, iridium and platinum. In addition to these metals, other promoters may also be employed in conjunction therewith, including the metals of Group VIB, e.g., molybdenum and tungsten. The amount of hydrogenating metal in the catalyst can vary within wide ranges. Broadly speaking, any amount between 0.05 percent and 30 percent by weight may be used. In the case of the noble metals, it is normally preferred to use 0.05 to 2 wt-%.

The foregoing catalysts may be employed in undiluted form, or the powdered catalyst may be mixed and copelleted with other relatively less active catalysts, diluents or binders such as alumina, silica gel, silica-alumina cogels, activated clays and the like in proportions ranging between 5 and 90 wt-%. These diluents may be employed as such or they may contain a minor proportion of an added hydrogenating metal such as a Group VIB and/or Group VIII metal. Additional metal promoted hydrocracking catalysts may also be utilized in the process of the present invention which comprise, for example, aluminophosphate molecular sieves, crystalline chromosilicates and other crystalline silicates.

The hydrocracking catalyst preferably has high activity such as comprising at 40 to 60 wt-% dealuminated Y zeolite or at least 15 to 35 wt-% non-dealuminated Y zeolite or at least 3 to 10 wt-% beta zeolite, or some combination thereof yielding similar activity. In each case, mass-transfer limitations are expected to be significant and thus smaller-diameter extrudates such as 1/16 inch cylinders or 1/16 inch trilobes may give the best performance. The hydrocracking catalyst beds of the hydrocracking reactor 320 may comprise 30 to 60% of the total catalyst volume in the hydrocracking reactor 320.

Referring back to FIG. 1, at least a portion of the first hydrocracked effluent stream in line 132 may be fractioned in the fractionation column 180 to provide a LPG fraction, a heavy naphtha fraction, a light diesel fraction, and a heavy diesel fraction. At least portion of the first hydrocracked effluent stream in line 132 may be passed to a hot separator 140 to provide a vaporous stream in line 142 and a liquid stream in line 144. At least a portion of the liquid stream may be passed to the fractionation column 180. As shown, the first hydrocracked effluent stream in line 132 may be passed to the hot separator 140 to separate the at least portion of the first hydrocracked effluent stream in to a vaporous stream in line 142 and a liquid stream in line 144. In an aspect, the hot separator 140 may be in direct communication with the first hydrocracking reactor 130 via the first hydrocracked effluent stream in line 132. Accordingly, the first hydrocracked effluent stream in line 132 may be passed directly to the hot separator 140. Suitable operating conditions of the hot separator 140 include, for example, a temperature of 260° C. to 320° C. The hot separator 140 may be operated at a slightly lower pressure than the first hydrocracking reactor 130 accounting for pressure drop of intervening equipment. Although not shown, the hot separator may have a corresponding flash drum and the first hydrocracked effluent stream in line 132 may be let down in pressure and flashed in the hot flash drum.

The vaporous stream in line 142 may be passed to a first separator 150 to provide a first vaporous stream in line 152 and a first liquid stream in line 154. At least a portion of the first liquid stream in line 154 may be passed to the fractionation column 180 for fractionation. In various embodiments, the first separator 150 is a cold separator. Suitable operating conditions of the cold separator 150 include, for example, a temperature of 20° C. to 60° C. and just below the pressure of the first hydrocracking reactor and the hot separator. Although not shown, the cold separator 150 may have a corresponding flash drum and the first liquid stream in line 154 may be let down in pressure and flashed in the cold flash drum.

The first vaporous stream in line 152 may be passed to a scrubber 230 to provide a hydrogen rich gaseous stream in line 232 which may be recycled to the first hydrocracking reactor 130. Use of the scrubber 230 is optional and the first vaporous stream in line 152 may be recycled to the first hydrocracking reactor 130 directly. Accordingly, at least a portion of the first vaporous stream is passed to the first hydrocracking reactor as the hydrogen stream. Further, the hydrogen rich gaseous stream in line 232 may be combined with a second vaporous stream in line 222 and passed to the first hydrocracking reactor 130 as hydrogen stream as described hereinafter in detail.

As shown, the first liquid stream in line 154 may be combined with the liquid stream in line 144 from the hot separator 140 to provide a combined liquid stream in line 156 which may be passed to a common stripper 160 for stripping. As shown, at least a portion of a second liquid stream in line 224 from a second separator 220 may be passed to the common stripper 160 along with the combined liquid stream in line 156. Accordingly, at least a portion of the first hydrocracked effluent stream and at least a portion of the second hydrocracked effluent stream are passed to the common stripper before the step of fractionation. In an embodiment, the step of fractionation comprises passing the at least portion of the first hydrocracking effluent stream and the at least portion of the second hydrocracking effluent stream to a single fractionation column. Although, not shown in FIG. 1, the at least portion of the first liquid stream in line 144 and the liquid stream in line 154 may be passed to the stripper 160 separately. Any suitable stripping media can be used in the stripper 160 to separate the remaining gas fractions in line 162 and to provide a stripped liquid stream in line 164. Preferably, the stripping media is steam. The vapor fraction in line 162 may be further used in the process.

Thereafter, the stripped liquid stream in line 164 may be passed to a pre-heater 170 to heat the stripped liquid stream to a predetermined temperature before passing to the fractionation column 180 in line 172 to fractionate the stripped liquid stream into various fractions based on their boiling range including but not limited to the LPG fraction, the heavy naphtha fraction, the light diesel fraction, and the heavy diesel fraction. In an aspect, stripped liquid stream in line 164 may be sent directly to the fractionation column 180. As shown, the LPG fraction is withdrawn in line 182, the heavy naphtha fraction is withdrawn in line 184, the light diesel fraction is withdrawn in line 186, and the heavy diesel fraction is withdrawn in line 188. In an exemplary embodiment as shown in FIG. 1, at least a portion of the light diesel fraction in line 186 is passed to the second hydrocracking reactor 210 to maximize the production of heavy naphtha. In another embodiment, at least a portion of the heavy diesel fraction in line 188 may be passed to the first hydrocracking reactor 130 to maximize the production of heavy naphtha.

Moving now to the second hydrocracking reactor 210, the light diesel stream in line 112 may be passed to the second hydrocracking reactor 210 wherein the light diesel stream is hydrocracked in the presence of a hydrogen stream and a second hydrocracking catalyst in the second hydrocracking reactor operating at second hydrocracking conditions comprising a second hydrocracking pressure of 3450 kPa (500 psig) to 6205 kPa (900 psig) to provide a second hydrocracked effluent stream. The light diesel stream in line 112 may be passed to a pre-heater 190 to provide a pre-heated light diesel stream. As shown, the light diesel stream in line 112 may be combined with the light diesel fraction in line 186 and passed to the pre-heater 190 to provide a pre-heated light diesel stream in line 192. However, the light diesel stream in line 112 and the light diesel fraction in line 186 may be passed to the pre-heater 190 separately. Further, a kerosene stream from an external source may also be passed to the second hydrocracking reactor 210 for hydrocracking with the light diesel stream.

Further, a compression system 200 is provided to compress a make-up hydrogen stream in line 202. The compression system 200 may be a multistage compression system comprising at least two compressors. In an exemplary embodiment as shown in FIG. 1, the compression system 200 of the process of the present disclosure may comprises two compressors. The compression system 200 may compress the make-up hydrogen stream in line 202 to provide compressed make-up hydrogen stream in line 204 which is passed to the second hydrocracking reactor 210 as the hydrogen stream.

The second hydrocracking reactor 210 may comprise one or more beds of a second hydrocracking catalyst. Further, each bed may comprise similar or different catalyst compared to the other beds of the second hydrocracking reactor 210. The second hydrocracking catalyst of the second hydrocracking reactor can be similar or different compared the first hydrocracking catalyst of the first hydrocracking reactor 130 or can be a mixture thereof. Although not shown in FIG. 1, the pre-heated light diesel stream in line 192 may be separated into a plurality of streams. Therefore, a stream from the plurality of streams may be sent to a top hydrocracking catalyst bed and remaining streams being passed to the downstream hydrocracking catalyst beds in the second hydrocracking reactor 210 as a quench stream for the stream coming through the upstream hydrocracking catalyst bed.

Referring back to FIG. 1, at least a portion of the second hydrocracked effluent stream may be fractioned in the fractionation column 180 to produce heavy naphtha. Accordingly, at least a portion of the first hydrocracked effluent stream and at least a portion of the second hydrocracked effluent stream are fractioned in the fractionation column 180 to produce heavy naphtha. The second hydrocracked effluent stream, withdrawn from the bottom of the second hydrocracking reactor 210 in line 212, may be passed to the fractionation column 180. As shown, the second hydrocracked effluent stream in line 212 may be passed to the second separator 220. The second separator 220 separates the second hydrocracked effluent stream to provide a second vaporous stream in line 222 and a second liquid stream in line 224. In various embodiments, the second separator 220 is a cold separator. Suitable operating conditions of the cold separator 220 include, for example, a temperature of 20° C. to 60° C. and just below the pressure of the second hydrocracking reactor. Although not shown, the cold separator may have a corresponding flash drum and the liquid fraction in line 224 may be let down in pressure and flashed in the cold flash drum.

At least a portion of the second liquid stream may be passed to the fractionation column 180. As shown in FIG. 1, the second liquid stream in line 224 may be passed to the common stripper 160 along with the combined liquid stream in line 156 and processed further as previously described. Accordingly, at least a portion of the first hydrocracked effluent stream and the at least a portion of the second hydrocracked effluent stream are passed to the single fractionation column 180. In an alternate scheme, the at least portion of the first hydrocracking effluent stream and the at least portion of the second hydrocracking effluent may be fractioned separately to provide the heavy naphtha. Accordingly, the step of fractionation may comprise passing the at least portion of the first hydrocracking effluent stream to a first fractionation column and passing the at least portion of the second hydrocracking effluent stream to a second fractionation column to produce heavy naphtha.

Referring back to second vaporous stream in line 222, entirety of the second vaporous stream may be passed to the first hydrocracking reactor 130. The second vaporous stream in line 222 comprises predominantly hydrogen and may be recycled to the first hydrocracking reactor 130 via a recycle line 222 after compressing to a predetermined pressure in a compressor 240. As shown, the hydrogen rich gaseous stream in line 232 may be combined with the second vaporous stream in line 222 to provide a combined recycle stream in line 234. Thereafter the combined recycle stream in line 234 may be compressed in the compressor 240 and the compressed recycle stream may be passed to the first hydrocracking reactor 130 as previously described. As shown, the combined recycle stream may be preheated and thereafter passed to the first hydrocracking reactor 130 in line 242. Accordingly, the entirety of the second vaporous stream and the at least portion of the first vaporous stream are passed to the first hydrocracking reactor as the hydrogen stream.

Conventionally, a diesel stream requires high pressure for hydrocracking usually, ranging from 13790 kPa (2000 psig) to 17237 kPa (2500 psig), thereby, posing economic constrains for diesel hydrocracking. Applicants have discovered that the hydrocarbon feed stream comprising diesel can be first split into a light diesel stream and heavy diesel stream thereby allowing the two stream to be processed in two different flow schemes at different process conditions. The light diesel stream is hydrocracked in a light diesel hydrocracking reactor at a pressure from 3450 kPa (500 psig) to 6205 kPa (900 psig) and the heavy diesel stream is routed to a heavy diesel hydrocracking reactor operating at a higher pressure as compared to the light diesel hydrocracking reactor.

Heavy diesel is typically hydrocracked at a pressure of 13790 kPa (2000 psig) to 17237 kPa (2500 psig). Therefore, instead of hydrocracking the whole diesel stream at 13790 kPa (2000 psig) to 17237 kPa (2500 psig), the present process allows splitting the diesel stream in to the light diesel stream and the heavy diesel stream and hydrocracking the light diesel stream at a lower pressure of 3450 kPa (500 psig) to 6205 kPa (900 psig) compared to the heavy diesel stream. Also, hydrocracking the light diesel stream at this low pressure and particularly at a pressure of 3450 kPa (500 psig) to 6205 kPa (900 psig) as compared the heavy diesel stream, still results in a satisfactory yield of heavy naphtha. Thus, the present process provides at least two major advantages, first, by splitting the diesel stream, the size of the downstream hydrocracking unit has decreased. Second, instead of operating at the higher pressure of 13790 kPa (2000 psig) to 17237 kPa (2500 psig), the process allows hydrocracking the light diesel stream at a lower pressure of 3450 kPa (500 psig) to 6205 kPa (900 psig) compared to the heavy diesel stream. Thus, the present process lowers a throughput to the downstream hydrocracking unit and also provides hydrocracking of the light diesel stream at a lower pressure compared to the conventional process.

Figure 2:
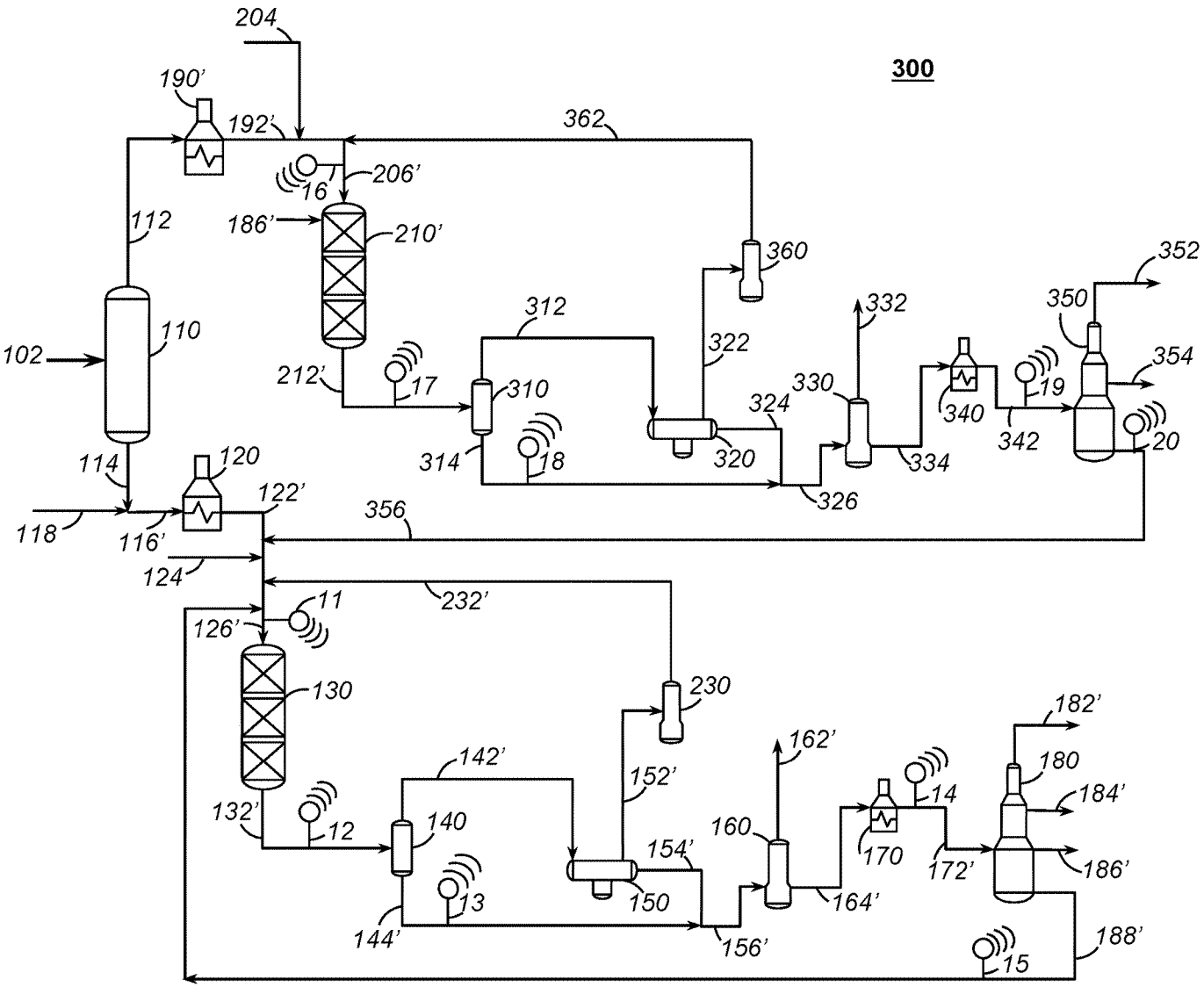
FIG. 2 is a schematic diagram of a process and apparatus for maximizing production of heavy naphtha from a hydrocarbon stream in accordance with another exemplary embodiment.

Turning now to FIG. 2, another exemplary embodiment of the process and apparatus for maximizing production of heavy naphtha from a hydrocarbon stream is addressed with reference to a process and apparatus 300. Many of the elements in the FIG. 2 have the same configuration or composition as in FIG. 1 and bear the same respective reference number and have similar operating conditions. Elements in FIG. 2 that correspond to elements in FIG. 1 but have a different configuration or composition bear the same reference numeral as in FIG. 1 but are marked with a prime symbol ('). The apparatus and process in FIG. 2 are the same as in FIG. 1 with the exception of the noted following differences. In accordance with the exemplary embodiment as shown in the FIG. 2, the process and apparatus includes a hot separator 310, a second separator 320, a second stripping column 330, a second fractionation column 350 in addition to the first fractionation column 180.

As shown in FIG. 2, a vacuum gas oil (VGO) stream in line 118 may also be passed to the first hydrocracking reactor 130 along with the heavy diesel stream in line 114. The vacuum gas oil (VGO) stream in line 118 and the heavy diesel stream in line 114 may be first combined and thereafter a combined stream in line 116' is passed to the pre-heater 120 to provide a preheated stream in line 122'. However, the vacuum gas oil (VGO) stream in line 118 and the heavy diesel stream in line 114 may be passed to the pre-heater 120 separately. The pre-heater 120 is optionally used to reduce the heat load on the downstream hydrocracking reactor. And, the vacuum gas oil (VGO) stream in line 118 and the heavy diesel stream in line 114 may be passed directly to the first hydrocracking reactor 130. As shown, the hydrogen stream in line 124 may be combined with preheated stream in line 122' and then passed to the first hydrocracking reactor 130. As described hereinafter in detail, the preheated stream in line 122' may be combined with a heavy diesel fraction in line 188', an unconverted diesel fraction in line 356, and a hydrogen rich gaseous stream in line 232' to obtain a combined stream in line 126'. Thereafter, the combined stream in line 126' is hydrocracked in the first hydrocracking reactor 130. In an alternate scheme, the preheated stream in line 122', the hydrogen stream in line 124, and the heavy diesel fraction in line 188', the unconverted diesel fraction in line 356, and the hydrogen rich gaseous stream in line 232' may be passed to the first hydrocracking reactor 130 separately.

In the first hydrocracking reactor 130, the heavy diesel stream and the vacuum gas oil (VGO) stream are hydrocracked in the presence of the hydrogen stream and a first hydrocracking catalyst at first hydrocracking conditions comprising a first hydrocracking pressure of 13790 kPa (2000 psig) to 17237 kPa (2500 psig) to provide the first hydrocracked effluent stream in line 132' from the bottom of the first hydrocracking reactor 130'.

At least a portion of the first hydrocracked effluent stream in line 132' may be passed to the first fractionation column 180 to provide one or more fractionation products including a LPG fraction, a heavy naphtha fraction, a light diesel fraction, and a heavy diesel fraction. At least a portion of the first hydrocracked effluent stream in line 132' may be passed to a hot separator 140 to provide a vaporous stream and a liquid stream. At least a portion of the liquid stream may be passed to the first fractionation column. As shown, the at least portion of the first hydrocracked effluent stream in line 132' may be passed to the hot separator 140 to separate the at least portion of the first hydrocracked effluent stream in to a vaporous stream in line 142' and a liquid stream in line 144'. In an aspect, the hot separator 140 may be in direct communication with the first hydrocracking reactor 130' via the first hydrocracked effluent stream in line 132'. Accordingly, the first hydrocracked effluent stream in line 132' may be passed directly to the hot separator 140.

The vaporous stream in line 142' may be further separated in the first separator 150 to provide a first vaporous stream in line 152' and a first liquid stream in line 154' wherein at least a portion of the first liquid stream in line 154' may be passed to the first fractionation column 180. The first vaporous stream in line 152' may be passed to the scrubber 230 to provide a hydrogen rich gaseous stream in line 232' which may be recycled to the first hydrocracking reactor 130' as described above. Accordingly, at least a portion of the first vaporous stream is passed to the first hydrocracking reactor 130. Use of the scrubber 190 is optional and the first vaporous stream in line 192' may be recycled to the first hydrocracking reactor 130' directly. Further, the hydrogen rich gaseous stream in line 232' may be combined with the hydrogen stream in line 124 and passed to the first hydrocracking reactor 130'.

At least a portion of the first liquid stream in line 154' may be combined with the liquid stream in line 144' from the hot separator 140 to provide a combined liquid stream in line 156' which may be passed to the first stripper 160' for stripping. Although, not shown in FIG. 2, the at least portion of the first liquid stream in line 144' and the liquid stream in line 154' may be passed to the first stripper 160' separately. Thereafter, the stripped liquid stream in line 164' may be passed to the pre-heater 170 to heat the stripped liquid stream to a predetermined temperature before passing to the first fractionation column 180 in line 172' to fractionate the stripped liquid stream into various fractions based on their boiling range including but not limited to the LPG fraction, the heavy naphtha fraction, the light diesel fraction, and the heavy diesel fraction. In an aspect, stripped liquid stream in line 164' may be sent directly to the first fractionation column 180. As shown, the LPG fraction is withdrawn in line 182', the heavy naphtha fraction is withdrawn in line 184', the light diesel fraction is withdrawn in line 186', and the heavy diesel fraction is withdrawn in line 188'. In an embodiment, at least a portion of the heavy diesel fraction in line 188' may be recycled to the first hydrocracking reactor 130 and at least a portion of the light diesel fraction in line 186' may be recycled to the second hydrocracking reactor 210' to maximize the production of heavy naphtha.

As described herein, the VGO stream can also be hydrocracked in the heavy diesel hydrocracking reactor along with the heavy diesel stream. Also, the heavy diesel hydrocracking reactor can be a VGO hydrocracking reactor to allow the hydrocracking of the VGO stream and the heavy diesel stream in single hydrocracking reactor owing to the higher pressure for both the heavy diesel and the VGO stream. Accordingly, the hydrocarbon feed stream comprising diesel can be split in to the light diesel stream and the heavy diesel stream. The light diesel stream can be processed at a hydrocracking pressure of 3450 kPa (500 psig) to 6205 kPa (900 psig) and the heavy diesel stream is routed to the VGO hydrocracking reactor to hydrocrack the heavy diesel stream along with the VGO stream at pressure of 13790 kPa (2000 psig) to 17237 kPa (2500 psig). Thus, allowing the light diesel hydrocracking reactor to operate at a lower pressure with integrating the process with an existing VGO hydrocracking reactor thereby reducing the Capex and Opex of the combined units.

Referring back to FIG. 2, the light diesel stream in line 112 may be passed to a second hydrocracking reactor 210' wherein the light diesel stream in line 112 is hydrocracked in the presence of a hydrogen stream and a second hydrocracking catalyst in the second hydrocracking reactor operating at second hydrocracking conditions comprising a second hydrocracking pressure of 3450 kPa (500 psig) to 6205 kPa (900 psig) to provide a second hydrocracked effluent stream. As shown, the light diesel stream in line 112 may be passed to a pre-heater 190' to provide a pre-heated light diesel stream in line 192'. The hydrogen stream in line 204 may also be combined with the pre-heated light diesel stream in line 192' and thereafter passed to the second hydrocracking reactor 210'. The pre-heater 220 is optionally used to reduce the heat load on the downstream hydrocracking reactor. Accordingly, the light diesel stream in line 112 may be passed to the second hydrocracking reactor 210' directly. As shown, at least a portion of the light diesel fraction from the first fractionation column 180 in line 186' may also be passed to the second hydrocracking reactor 210' to maximize the production of heavy naphtha. As described herein after in detail, a hydrogen rich gaseous stream in line 362 may also be combined with the pre-heated light diesel stream and thereafter the combined stream in line 206' may be passed to the second hydrocracking reactor 210'. Although not shown in FIG. 2, the hydrogen rich gaseous stream in line 362, the pre-heated light diesel stream in line 192', and the hydrogen stream in line 204 may be passed to the second hydrocracking reactor 210' separately. Further, a kerosene stream from an external source may also be passed to the second hydrocracking reactor 210' for hydrocracking with the light diesel stream.

The second hydrocracking reactor 210' may comprise one or more beds of the second hydrocracking catalyst to provide the second hydrocracked effluent stream in line 212'. Although not shown in FIG. 2, the stream in line 206' may be separated into a plurality of streams. Therefore, a stream from the plurality of streams may be sent to a top hydrocracking catalyst bed and remaining streams being passed to the downstream hydrocracking catalyst beds in the second hydrocracking reactor 210' as a quench stream for the stream coming through the upstream hydrocracking catalyst bed. Each bed may comprise similar or different hydrocracking catalyst compared to the other beds of the second hydrocracking reactor 210'. The second hydrocracking catalyst of the second hydrocracking reactor can be similar or different compared the first hydrocracking catalyst of the first hydrocracking reactor 130' or can be a mixture thereof.

At least a portion of the second hydrocracked effluent stream in line 212' may be passed to the second fractionation column 350 to provide one or more fractionation products including a LPG fraction, a heavy naphtha fraction, and an unconverted diesel fraction. The at least portion of the second hydrocracked effluent stream in line 212' may be passed to the hot separator 310 to provide a vaporous stream. As shown, the at least portion of the second hydrocracked effluent stream in line 212' may be passed to the hot separator 310 to separate the at least portion of the second hydrocracked effluent stream in to a vaporous stream in line 312 and a liquid stream in line 314. In an aspect, the hot separator 310 may be in direct communication with the second hydrocracking reactor 210' via the second hydrocracked effluent stream in line 212'. Accordingly, the second hydrocracked effluent stream in line 212' may be passed directly to the hot separator 310. Suitable operating conditions of the hot separator 310 include, for example, a temperature of 260° C. to 320° C. The hot separator 310 may be operated at a slightly lower pressure than the second hydrocracking reactor 210' accounting for pressure drop of intervening equipment. Although not shown, the hot separator may have a corresponding flash drum and the liquid stream in line 314 may be let down in pressure and flashed in the hot flash drum.

The vaporous stream in line 312 may be separated in a second separator 320 to provide second vaporous stream in line 322 and a second liquid stream in line 324 wherein at least a portion of the second liquid stream in line 324 may be passed to the second fractionation column 350. In various embodiments, the second separator 320 is a cold separator. Suitable operating conditions of the cold separator 320 include, for example, a temperature of 20° C. to 60° C. and a pressure just below the pressure of the second hydrocracking reactor 210' and the hot separator 310. Although not shown, the cold separator 320 may have a corresponding flash drum and the second liquid stream in line 324 may be let down in pressure and flashed in the cold flash drum. The second vaporous stream in line 322 may be passed to a scrubber 360 to provide a hydrogen rich gaseous stream in line 362 which may be recycled to the second hydrocracking reactor 210'. Use of the scrubber 360 is optional and the second vaporous stream in line 322 may be recycled to the second hydrocracking reactor 210' directly. In an alternate scheme, the hydrogen rich gaseous stream in line 362 may be combined with the hydrogen stream in line 204 and passed to the second hydrocracking reactor 210'.

At least a portion of the first liquid stream in line 324 may be combined with the liquid stream in line 314 from the hot separator 310 to provide a combined liquid stream in line 326 which may be sent to a second stripper 330 for stripping. Although, not shown in FIG. 2, the at least portion of the second liquid stream in line 324 and the liquid stream in line 314 may be passed to the second stripper 330 separately.

Thereafter, the stripped liquid stream in line 334 may be passed to a pre-heater 340 to heat the stripped liquid stream to a predetermined temperature before passing to the second fractionation column 350 in line 342 to fractionate the stripped liquid stream into various fractions based on their boiling range including but not limited to the LPG fraction, the heavy naphtha fraction, and the unconverted diesel fraction. In an aspect, stripped liquid stream in line 334 may be sent directly to the second fractionation column 350. As shown, the LPG fraction is withdrawn in line 352, the heavy naphtha fraction is withdrawn in line 354, and the unconverted diesel fraction is withdrawn in line 356. In an embodiment, the unconverted diesel fraction in line 356 may be recycled to the first hydrocracking reactor 130' for further hydrocracking. As shown, the unconverted diesel fraction in line 356 may be combined with the pre-heated stream in line 122' and passed to the first hydrocracking reactor 130'. In an alternate scheme, at least a portion of the unconverted diesel fraction in line 356 may be recycled to the second hydrocracking reactor 210' and the remaining portion may be recycled to the first hydrocracking reactor 130'.

The present flow scheme allows the integration of diesel hydrocracking with an existing VGO hydrocracking unit to produce heavy naphtha. Conventionally, the VGO hydrocracking unit operates at a pressure from 13790 kPa (2000 psig) to 17237 kPa (2500 psig). Also, hydrocracking of a heavy diesel stream is performed at the similar pressure range. Applicants have found out that the hydrocarbon feed stream comprising diesel can be split into a light diesel stream and a heavy diesel stream and light diesel and processed further as detailed in the present disclosure to achieve savings in Capex and Opex. Specifically, the heavy diesel stream is hydrocracked at a hydrocracking pressure from 13790 kPa (2000 psig) to 17237 kPa (2500 psig) along with a VGO stream in an existing VGO hydrocracking unit.

And, the light diesel stream is hydrocracked in a light diesel hydrocracking reactor at a hydrocracking pressure from 3450 kPa (500 psig) to 6205 kPa (900 psig). Thus, instead of operating two hydrocracking unit at a pressure of 13790 kPa (2000 psig) to 17237 kPa (2500 psig) for heavy diesel and VGO stream, the present flow schemes allows integration of diesel hydrocracking with an existing VGO hydrocracking unit thereby hydrocracking the light diesel stream at a pressure from 3450 kPa (500 psig) to 6205 kPa (900 psig) and the heavy diesel stream at hydrocracking pressure from 13790 kPa (2000 psig) to 17237 kPa (2500 psig) in a VGO hydrocracking unit thereby reducing Capex and Opex for the whole flow scheme.

Any of the above lines, conduits, units, devices, vessels, surrounding environments, zones or similar may be equipped with one or more monitoring components including sensors, measurement devices, data capture devices or data transmission devices. Signals, process or status measurements, and data from monitoring components may be used to monitor conditions in, around, and on process equipment. Signals, measurements, and/or data generated or recorded by monitoring components may be collected, processed, and/or transmitted through one or more networks or connections that may be private or public, general or specific, direct or indirect, wired or wireless, encrypted or not encrypted, and/or combination(s) thereof; the specification is not intended to be limiting in this respect. Further, the figure shows one or more exemplary sensors such as 11, 12, 13, 14, 15, 16, 17, 18, 19 and 20 located on or more conduits. Nevertheless, there may be sensors present on every stream to control the corresponding parameter(s) accordingly.

Signals, measurements, and/or data generated or recorded by monitoring components may be transmitted to one or more computing devices or systems. Computing devices or systems may include at least one processor and memory storing computer-readable instructions that, when executed by the at least one processor, cause the one or more computing devices to perform a process that may include one or more steps. For example, the one or more computing devices may be configured to receive, from one or more monitoring component, data related to at least one piece of equipment associated with the process. The one or more computing devices or systems may be configured to analyze the data. Based on analyzing the data, the one or more computing devices or systems may be configured to determine one or more recommended adjustments to one or more parameters of one or more processes described herein. The one or more computing devices or systems may be configured to transmit encrypted or unencrypted data that includes the one or more recommended adjustments to the one or more parameters of the one or more processes described herein.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention. It being understood that various changes may be made in the function and arrangement of elements described in an exemplary embodiment without departing from the scope of the invention as set forth in the appended claims.

SPECIFIC EMBODIMENTS

While the following is described in conjunction with specific embodiments, it will be understood that this description is intended to illustrate and not limit the scope of the preceding description and the appended claims.

A first embodiment of the invention is a process for maximizing production of heavy naphtha from a hydrocarbon stream comprising providing a hydrocarbon feed stream comprising diesel to a separator to provide a light diesel stream and a heavy diesel stream; hydrocracking the heavy diesel stream in the presence of a hydrogen stream and a first hydrocracking catalyst in a first hydrocracking reactor operating at first hydrocracking conditions comprising a first hydrocracking pressure of 13790 kPa (2000 psig) to 17237 kPa (2500 psig) to provide a first hydrocracked effluent stream; hydrocracking the light diesel stream in the presence of a hydrogen stream and a second hydrocracking catalyst in a second hydrocracking reactor operating at second hydrocracking conditions comprising a second hydrocracking pressure of 3450 kPa (500 psig) to 6205 kPa (900 psig) to provide a second hydrocracked effluent stream; and fractionating at least a portion of the first hydrocracked effluent stream and at least a portion of the second hydrocracked effluent stream to produce heavy naphtha. An embodiment of the invention is one, any or all of prior embodiments in this paragraph up through the first embodiment in this paragraph further comprising passing a vacuum gas oil (VGO) stream to the first hydrocracking reactor to provide the first hydrocracked effluent stream. An embodiment of the invention is one, any or all of prior embodiments in this paragraph up through the first embodiment in this paragraph further comprising passing at least a portion of the first hydrocracked effluent stream to a hot separator to provide a vaporous stream and a liquid stream and passing at least a portion of the liquid stream to a fractionation column. An embodiment of the invention is one, any or all of prior embodiments in this paragraph up through the first embodiment in this paragraph further comprising passing the vaporous stream to a first separator to provide a first vaporous stream and a first liquid stream and passing at least a portion of the first liquid stream to the fractionation column. An embodiment of the invention is one, any or all of prior embodiments in this paragraph up through the first embodiment in this paragraph further comprising passing the second hydrocracked effluent stream to a second separator to provide a second vaporous stream and a second liquid stream and passing at least a portion of the second liquid stream to the fractionation column. An embodiment of the invention is one, any or all of prior embodiments in this paragraph up through the first embodiment in this paragraph, wherein the entirety of the second vaporous stream is passed to the first hydrocracking reactor. An embodiment of the invention is one, any or all of prior embodiments in this paragraph up through the first embodiment in this paragraph, wherein the at least a portion of the first hydrocracked effluent stream and the at least a portion of the second hydrocracked effluent stream are passed to a common stripper before the step of fractionation. An embodiment of the invention is one, any or all of prior embodiments in this paragraph up through the first embodiment in this paragraph, wherein the step of fractionation comprises passing the at least portion of the first hydrocracking effluent stream and the at least portion of the second hydrocracking effluent stream to a single fractionation column. An embodiment of the invention is one, any or all of prior embodiments in this paragraph up through the first embodiment in this paragraph, wherein the step of fractionation comprises passing the at least portion of the first hydrocracking effluent stream to a first fractionation column and passing the at least portion of the second hydrocracking effluent stream to a second fractionation column. An embodiment of the invention is one, any or all of prior embodiments in this paragraph up through the first embodiment in this paragraph, further comprising at least one of sensing at least one parameter of the process for maximizing production of heavy naphtha and generating a signal or data from the sensing; generating and transmitting a signal; or generating and transmitting data.

A second embodiment of the invention is a process for maximizing production of heavy naphtha from a hydrocarbon stream comprising providing a hydrocarbon feed stream comprising diesel to a separator to provide a light diesel stream and a heavy diesel stream; hydrocracking the heavy diesel stream in the presence of a hydrogen stream and a first hydrocracking catalyst in a first hydrocracking reactor operating at first hydrocracking conditions comprising a first hydrocracking pressure of 13790 kPa (2000 psig) to 17237 kPa (2500 psig) to provide a first hydrocracked effluent stream; hydrocracking the light diesel stream in the presence of a hydrogen stream and a second hydrocracking catalyst in a second hydrocracking reactor operating at second hydrocracking conditions comprising a second hydrocracking pressure of 3450 kPa (500 psig) to 6205 kPa (900 psig) to provide a second hydrocracked effluent stream; fractionating at least a portion of the first hydrocracked effluent stream and at least a portion of the second hydrocracked effluent stream to provide a heavy naphtha fraction, a light diesel fraction, and a heavy diesel fraction; and passing at least a portion of the heavy diesel fraction to the first hydrocracking reactor; and passing at least a portion of the light diesel fraction to the second hydrocracking reactor to maximize the production of heavy naphtha. An embodiment of the invention is one, any or all of prior embodiments in this paragraph up through the second embodiment in this paragraph further comprising passing at least a portion of the first hydrocracked effluent stream to a hot separator to provide a vaporous stream and a liquid stream; passing at least a portion of the liquid stream to a fractionation column; separating the vaporous stream to provide a first vaporous stream and a first liquid stream; passing at least a portion of the first liquid stream to the fractionation column; passing the second hydrocracked effluent stream to a second separator to provide a second vaporous stream and a second liquid stream; passing at least a portion of the second liquid stream to the fractionation column; and passing the entirety of the second vaporous stream and at least a portion of the first vaporous stream to the first hydrocracking reactor as the hydrogen stream. An embodiment of the invention is one, any or all of prior embodiments in this paragraph up through the second embodiment in this paragraph further comprising passing a vacuum gas oil (VGO) stream to the first hydrocracking reactor to provide the first hydrocracked effluent stream. An embodiment of the invention is one, any or all of prior embodiments in this paragraph up through the second embodiment in this paragraph, wherein the step of fractionation comprises passing the at least portion of the first hydrocracking effluent stream to a first fractionation column and passing the at least portion of the second hydrocracking effluent stream to a second fractionation column.

A third embodiment of the invention is a process for maximizing production of heavy naphtha from a hydrocarbon stream comprising providing a hydrocarbon feed stream comprising diesel to a separator to provide a light diesel stream and a heavy diesel stream; hydrocracking the heavy diesel stream and a vacuum gas oil stream in the presence of a hydrogen stream and a first hydrocracking catalyst in a first hydrocracking reactor at first hydrocracking conditions comprising a first hydrocracking pressure of 13790 kPa (2000 psig) to 17237 kPa (2500 psig) to provide a first hydrocracked effluent stream; passing at least a portion of the first hydrocracked effluent stream to a first fractionation column to provide one or more fractionation products including a heavy naphtha stream, a heavy diesel fraction and a light diesel fraction. hydrocracking the light diesel stream in a second hydrocracking reactor operating at second hydrocracking conditions comprising a second hydrocracking pressure of 3450 kPa (500 psig) to 6205 kPa (900 psig) to provide a second hydrocracked effluent stream; passing the second hydrocracked effluent stream to a second fractionation column to provide one or more fractionation products including a heavy naphtha stream; passing at least a portion of the heavy diesel fraction to the first hydrocracking reactor; and passing at least a portion of the light diesel fraction to the second hydrocracking reactor to maximize the production of heavy naphtha. An embodiment of the invention is one, any or all of prior embodiments in this paragraph up through the third embodiment in this paragraph further comprising passing at least a portion of the first hydrocracked effluent stream to a hot separator to provide a vaporous stream and a liquid stream and passing at least a portion of the liquid stream to the first fractionation column. An embodiment of the invention is one, any or all of prior embodiments in this paragraph up through the third embodiment in this paragraph further comprising passing the vaporous stream to a first separator to provide a first vaporous stream and a first liquid stream and passing at least a portion of the first liquid stream to the first fractionation column. An embodiment of the invention is one, any or all of prior embodiments in this paragraph up through the third embodiment in this paragraph further comprising passing the second hydrocracked effluent stream to a second separator to provide a second vaporous stream and a second liquid stream and passing at least a portion of the second liquid stream to the second fractionation column. An embodiment of the invention is one, any or all of prior embodiments in this paragraph up through the third embodiment in this paragraph, wherein at least a portion of the first vaporous stream is passed to the first hydrocracking reactor An embodiment of the invention is one, any or all of prior embodiments in this paragraph up through the third embodiment in this paragraph, wherein at least a portion of the second vaporous stream is passed to the second hydrocracking reactor.

Without further elaboration, it is believed that using the preceding description that one skilled in the art can utilize the present invention to its fullest extent and easily ascertain the essential characteristics of this invention, without departing from the spirit and scope thereof, to make various changes and modifications of the invention and to adapt it to various usages and conditions. The preceding preferred specific embodiments are, therefore, to be construed as merely illustrative, and not limiting the remainder of the disclosure in any way whatsoever, and that it is intended to cover various modifications and equivalent arrangements included within the scope of the appended claims.

The invention claimed is:

1. A process for maximizing production of heavy naphtha from a hydrocarbon stream comprising:

a) providing a hydrocarbon feed stream comprising diesel to a separation column to provide a light diesel stream and a heavy diesel stream;

b) hydrocracking the heavy diesel stream in the presence of a hydrogen stream and a first hydrocracking catalyst in a first hydrocracking reactor operating at first hydrocracking conditions comprising a first hydrocracking pressure of about 10340 kPa (1500 psig) to about 17237 kPa (2500 psig) to provide a first hydrocracked effluent stream, wherein the first hydrocracking catalyst comprises an amorphous silica-alumina base or a zeolite cracking base;

c) hydrocracking the light diesel stream in the presence of a hydrogen stream and a second hydrocracking catalyst in a second hydrocracking reactor operating at second hydrocracking conditions comprising a second hydrocracking pressure of about 2410 kPa (350 psig) to about 6205 kPa (900 psig) to provide a second hydrocracked effluent stream; and d) fractionating at least a portion of the first hydrocracked effluent stream and at least a portion of the second hydrocracked effluent stream to produce heavy naphtha.

2. The process of claim 1 further comprising passing a vacuum gas oil (VGO) stream to the first hydrocracking reactor to provide the first hydrocracked effluent stream.

3. The process of claim 1 further comprising passing at least a portion of the first hydrocracked effluent stream to a hot separator to provide a vaporous stream and a liquid stream and passing at least a portion of the liquid stream to a fractionation column.

4. The process of claim 3 further comprising passing the vaporous stream to a first separator to provide a first vaporous stream and a first liquid stream and passing at least a portion of the first liquid stream to the fractionation column.

5. The process of claim 1 further comprising passing the second hydrocracked effluent stream to a second separator to provide a second vaporous stream and a second liquid stream and passing at least a portion of the second liquid stream to the fractionation column.

6. The process of claim 5, wherein the entirety of the second vaporous stream is passed to the first hydrocracking reactor.

7. The process of claim 1, wherein the at least a portion of the first hydrocracked effluent stream and the at least a portion of the second hydrocracked effluent stream are passed to a common stripper before the step of fractionation.

8. The process of claim 1, wherein the step of fractionation comprises passing the at least portion of the first hydrocracking effluent stream and the at least portion of the second hydrocracking effluent stream to a single fractionation column.

9. The process of claim 1, wherein the step of fractionation comprises passing the at least portion of the first hydrocracking effluent stream to a first fractionation column and passing the at least portion of the second hydrocracking effluent stream to a second fractionation column.

10. The process of claim 1, further comprising at least one of:

sensing at least one parameter of the process for maximizing production of heavy naphtha and generating a signal or data from the sensing;

generating and transmitting a signal; or generating and transmitting data.

11. A process for maximizing production of heavy naphtha from a hydrocarbon stream comprising:

a) providing a hydrocarbon feed stream comprising diesel to a separation column to provide a light diesel stream from an overhead and a heavy diesel stream from a bottom of the separation column;

b) hydrocracking the heavy diesel stream in the presence of a hydrogen stream and a first hydrocracking catalyst in a first hydrocracking reactor operating at first hydrocracking conditions comprising a first hydrocracking pressure of about 10340 kPa (1500 psig) to about 17237 kPa (2500 psig) to provide a first hydrocracked effluent stream, wherein the first hydrocracking catalyst comprises an amorphous silica-alumina base or a zeolite cracking base;

c) hydrocracking the light diesel stream in the presence of a hydrogen stream and a second hydrocracking catalyst in a second hydrocracking reactor operating at second hydrocracking conditions comprising a second hydrocracking pressure of about 2410 kPa (350 psig) to about 6205 kPa (900 psig) to provide a second hydrocracked effluent stream;

d) fractionating at least a portion of the first hydrocracked effluent stream and at least a portion of the second hydrocracked effluent stream to provide a heavy naphtha fraction, a light diesel fraction, and a heavy diesel fraction;

e) passing at least a portion of the heavy diesel fraction to the first hydrocracking reactor; and f) passing at least a portion of the light diesel fraction to the second hydrocracking reactor to maximize the production of heavy naphtha.

12. The process of claim 11 further comprising:

a) passing at least a portion of the first hydrocracked effluent stream to a hot separator to provide a vaporous stream and a liquid stream;

b) passing at least a portion of the liquid stream to a fractionation column;

c) separating the vaporous stream to provide a first vaporous stream and a first liquid stream;

d) passing at least a portion of the first liquid stream to the fractionation column;

e) passing the second hydrocracked effluent stream to a second separator to provide a second vaporous stream and a second liquid stream;

f) passing at least a portion of the second liquid stream to the fractionation column; and g) passing the entirety of the second vaporous stream and at least a portion of the first vaporous stream to the first hydrocracking reactor as the hydrogen stream.

13. The process of claim 12 further comprising passing a vacuum gas oil (VGO) stream to the first hydrocracking reactor to provide the first hydrocracked effluent stream.

14. The process of claim 12, wherein the step of fractionation comprises passing the at least portion of the first hydrocracking effluent stream to a first fractionation column and passing the at least portion of the second hydrocracking effluent stream to a second fractionation column.

15. A process for maximizing production of heavy naphtha from a hydrocarbon stream comprising:

a) providing a hydrocarbon feed stream comprising diesel to a separation column to provide a light diesel stream from an overhead and a heavy diesel stream from a bottom of the separation column;

b) hydrocracking the heavy diesel stream and a vacuum gas oil stream in the presence of a hydrogen stream and a first hydrocracking catalyst in a first hydrocracking reactor at first hydrocracking conditions comprising a first hydrocracking pressure of about 10340 kPa (1500 psig) to about 17237 kPa (2500 psig) to provide a first hydrocracked effluent stream, wherein the first hydrocracking catalyst comprises an amorphous silica-alumina base or a zeolite cracking base;

c) passing at least a portion of the first hydrocracked effluent stream to a first fractionation column to provide one or more fractionation products including a heavy naphtha stream, a heavy diesel fraction and a light diesel fraction;

d) hydrocracking the light diesel stream in a second hydrocracking reactor operating at second hydrocracking conditions comprising a second hydrocracking pressure of about 2410 kPa (350 psig) to about 6205 kPa (900 psig) to provide a second hydrocracked effluent stream;

e) passing the second hydrocracked effluent stream to a second fractionation column to provide one or more fractionation products including a heavy naphtha stream;

f) passing at least a portion of the heavy diesel fraction to the first hydrocracking reactor; and g) passing at least a portion of the light diesel fraction to the second hydrocracking reactor to maximize the production of heavy naphtha.

16. The process of claim 15 further comprising passing at least a portion of the first hydrocracked effluent stream to a hot separator to provide a vaporous stream and a liquid stream and passing at least a portion of the liquid stream to the first fractionation column.

17. The process of claim 16 further comprising passing the vaporous stream to a first separator to provide a first vaporous stream and a first liquid stream and passing at least a portion of the first liquid stream to the first fractionation column.

18. The process of claim 15 further comprising passing the second hydrocracked effluent stream to a second separator to provide a second vaporous stream and a second liquid stream and passing at least a portion of the second liquid stream to the second fractionation column.

19. The process of claim 17, wherein at least a portion of the first vaporous stream is passed to the first hydrocracking reactor.

20. The process of claim 18, wherein at least a portion of the second vaporous stream is passed to the second hydrocracking reactor.

* * * * *